US010076215B1

(12) United States Patent
Quay et al.

(10) Patent No.: US 10,076,215 B1
(45) Date of Patent: Sep. 18, 2018

(54) PORTABLE BIDET SEAT

(71) Applicants: David Quay, Murrieta, CA (US); Donna Quay, Murrieta, CA (US)

(72) Inventors: David Quay, Murrieta, CA (US); Donna Quay, Murrieta, CA (US)

( * ) Notice: Subject to any disclaimer, the term of this patent is extended or adjusted under 35 U.S.C. 154(b) by 0 days.

(21) Appl. No.: 15/672,209

(22) Filed: Aug. 8, 2017

(51) Int. Cl.

| | |
|---|---|
| ***A47K 3/022*** | (2006.01) |
| ***A47K 3/26*** | (2006.01) |
| ***E03D 9/08*** | (2006.01) |
| ***A47K 3/12*** | (2006.01) |
| *E03C 1/12* | (2006.01) |

(52) U.S. Cl.
CPC ..... *A47K 3/26* (2013.01); *A47K 3/122* (2013.01); *E03D 9/08* (2013.01); *E03C 2001/1213* (2013.01)

(58) Field of Classification Search
CPC ..... A47K 3/26; A47K 3/122; E03D 9/08
USPC ..... 4/444
See application file for complete search history.

(56) References Cited

U.S. PATENT DOCUMENTS

| | | | | |
|---|---|---|---|---|
| 3,772,710 | A * | 11/1973 | Coutellier | A47K 13/00 4/443 |
| 4,259,754 | A * | 4/1981 | Bader | E03D 9/085 4/420.4 |
| 5,581,825 | A * | 12/1996 | Honsvald | E03D 9/08 4/444 |
| 2005/0132248 | A1 * | 6/2005 | Lecrone | G06F 11/2064 714/6.23 |

* cited by examiner

*Primary Examiner* — Huyen Le
(74) *Attorney, Agent, or Firm* — Palomar Patent; Mary Jo Redman

(57) ABSTRACT

Portable, self-contained bidet seat (10) to be placed on toilet or other waste disposal means. Bidet seat (10) holds washing liquid (100) in hollow central chamber (23). Pressure means (40) is activated by user to pressurize washing liquid (100) and air (101) in chamber (23). Pressurized liquid (100) is sprayed or jetted onto user to replace use of toilet paper. Bidet seat (10) is adapted for use by persons with limited strength or agility.

12 Claims, 3 Drawing Sheets

PORTABLE BIDET SEAT

FIELD OF THE INVENTION

This application related generally to a portable toilet riser seat, and more particularly to a toilet riser that functions as a self-contained bidet.

BACKGROUND OF THE INVENTION

Bidets have long been known as bath room appliances, separate from the toilet, but likewise connected to a source of running water and to a drain. Somewhat recently, the functions of toilet and bidet have been combined into a single appliance. Many people enjoy these integrated units in their homes or retrofit their existing toilet by adding a "bidet seat" that includes water spray means. The bidet seat is connected to the inlet pipe of the existing toilet as a source of pressurized fresh water and waste water is discharged through the toilet.

One reason for using bidet toilets is to avoid or minimize use of toilet paper, especially if the toilet discharges to a private septic system, to a municipal sewage treatment system of low efficiency, or even directly into a body of water. People of quite a few cultures are unused to, or even disgusted by, toilet paper or are required by religious rules to wash with water after elimination. Also, some people are not able to use toilet paper effectively due to lack of dexterity, strength, or flexibility in their hands or arms and find that washing is easier for them.

People with a strong aversion to toilet paper, or who cannot use toilet paper effectively and without pain, feel the lack of their personal bidet keenly when they must use other facilities such as hotel, restaurant, or public restrooms. Some attempts have been made to provide portable washing while seated on a toilet, such as adapting hand-held pressure sprayers, such as are used for insecticide application, for personal use. Such pressure sprayers are typically powered by hand pumping of a piston-type pump or by electricity, such as from an internal battery.

Some people with reduced use of their hands also have reduced strength in their legs and find it easier to sit down on and rise from a toilet with a higher seat than is typical in public restrooms. A portable sprayer does not help persons with mobility problems sit or arise safely from toilets that are too low for them.

There is a need for a device that can address both problems: needing to wash instead of (or in addition to) wiping with toilet paper and needing assistance to sit down or arise from a toilet seat. Such a device should be lightweight yet strong and stable, easy to operate and clean, reliable, and self-contained so as not to depend upon connection to running water or electricity.

SUMMARY OF THE INVENTION

The present invention is a portable and self-contained bidet seat, functioning as both a riser seat for a toilet and a portable bidet. It adds inches of height to any toilet it is placed on, can be used on toilets of various shapes and sizes, and requires no connection to tap water or electricity. The bidet seat can provide various types of spray or jet of water or other cleaning liquid to any desired portion of a user's body that is adjacent the opening of the bidet seat, such as buttocks, genitals, and anal area.

The bidet seat includes a hollow body with a height of two to eight inches, shaped generally like a conventional toilet seat, with an internal chamber for holding liquid. The hollow body is generally toroidal with a central aperture opening to the toilet but with an outer perimeter that is extended on the sides beyond a circular or elliptical outline. These wing-like extensions allow the bidet seat to be placed upon toilets of all shapes and sizes, can serve as handles, and give the user supportive surfaces to press on to assist standing and sitting down.

The bidet seat includes a pair of apertures in the outer wall, one in each of the extensions, with threaded rims. One aperture receives a spray pump and the other has a simple sealing cap that may be removed to introduce washing liquid into the chamber. The pump is typically operated by hand, such as by depressing a cylindrical piston. The chamber may alternatively be pressurized by a source of compressed gas, such as a miniature carbon dioxide cartridge.

Various nozzles, such as spray or jet, are disposed adjacent the central opening of the torus. Liquid is forced through them either indirectly, such as via a dip tube connected to the pump, or directly by compression of the gas inside the chamber. The liquid may be water or some other washing fluid, such as a no-rinse cleaning solution. An optional internal divider allows two different washing liquids to be contained in the chamber.

The bidet seat is preferably transported in a carrying bag and may contain washing liquid in the chamber during transport. Alternatively, tap water may be added from a tap inside a restroom. The pump may be pre-installed if desired, but is more typically carried detached and is then fitted into one of the threaded apertures of the body at time of use.

The portable bidet seat may be used in public, restrooms or at home, either on a conventional toilet or a portable commode. The bidet seat may also be placed on a camping toilet or the seat of a pit outhouse. Thus, it can provide improved hygiene and comfort in almost any situation for persons who either cannot or prefer not to use toilet paper, or who need to minimize its use.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
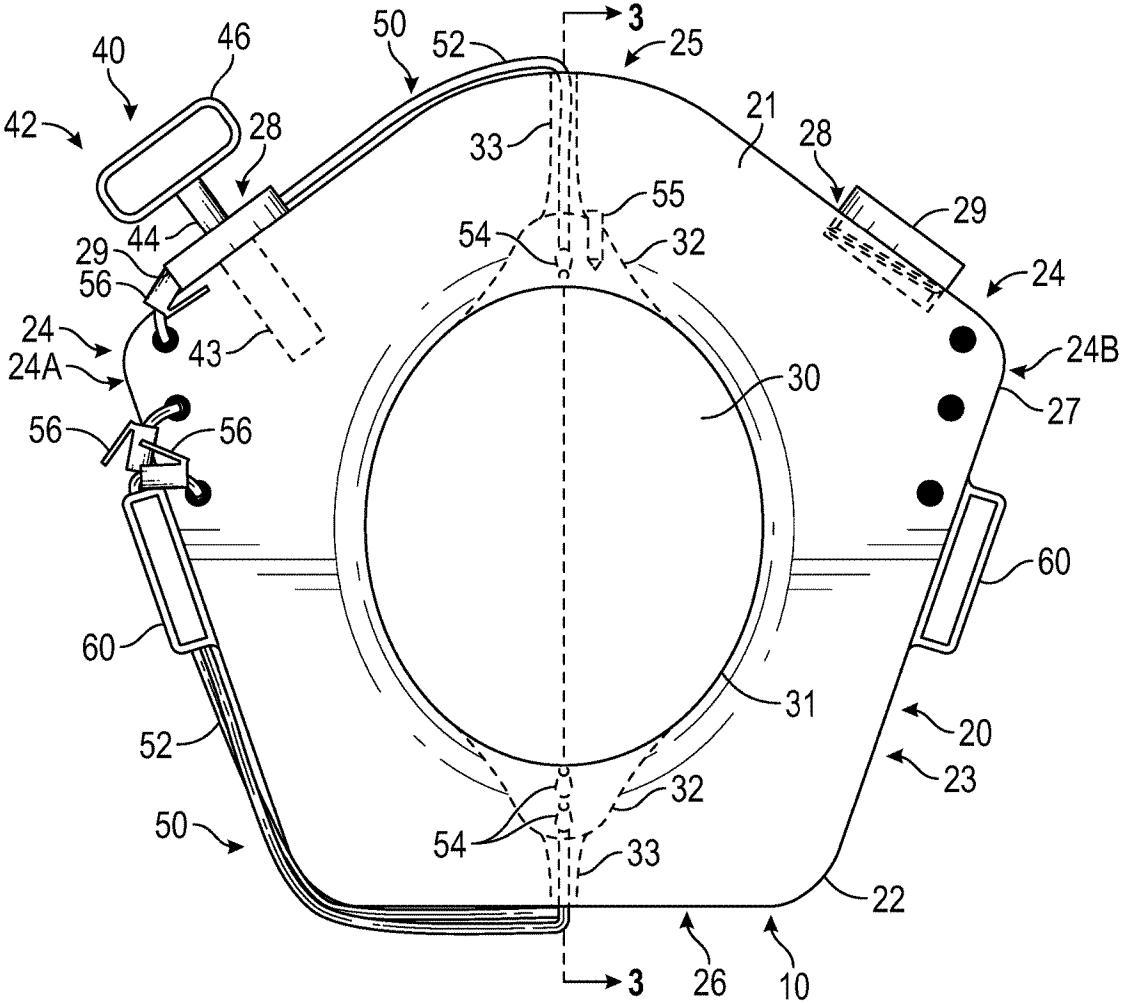
FIG. 1 is a top view of the portable bidet seat of the present invention.
Figure 2:
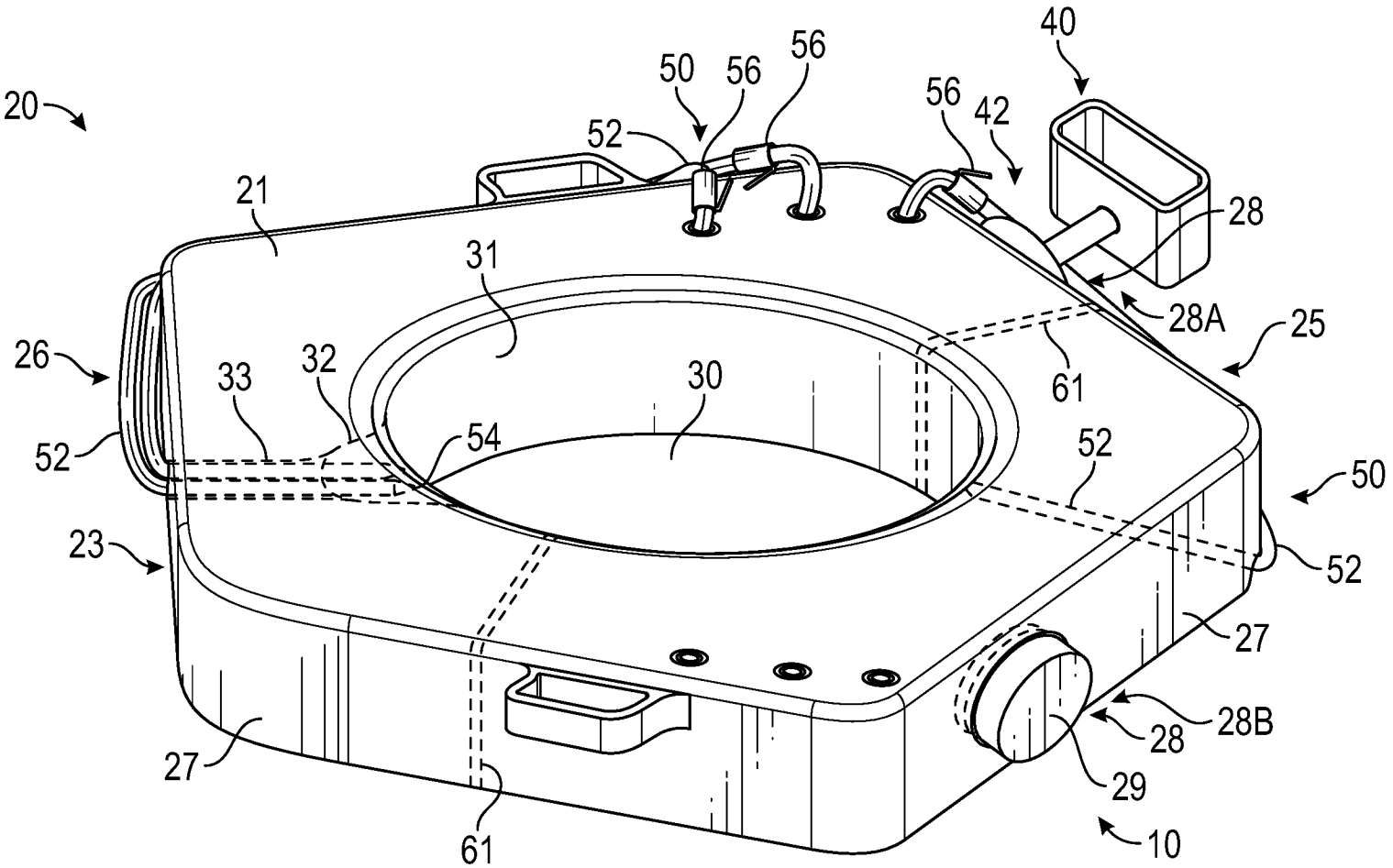
FIG. 2 is a side perspective view of the bidet seat of FIG. 1.
Figure 3:
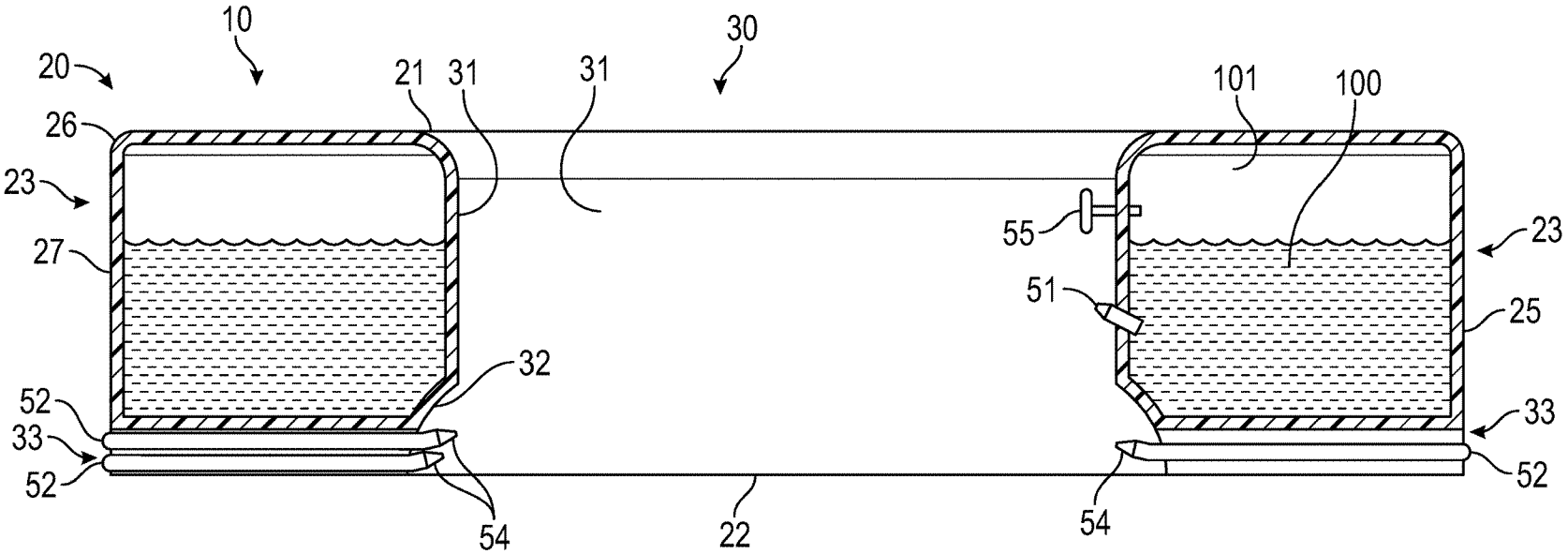
FIG. 3 is a sectional view of the bidet seat of FIG. 1, taken along line 3-3.

FIG. 1 is a top view of the portable bidet seat 10 of the present invention. FIG. 2 is a side perspective view of bidet seat 10 of FIG. 1. FIG. 3 is a sectional view of bidet seat 10 of FIG. 1, taken along line 3-3.

Looking first at FIG. 1, bidet seat 10 includes a hollow body 20 defining an interior central chamber 23 for containing a washing liquid 100 (FIG. 3), pressurizing means 40 for pressurizing washing liquid 100, and dispensing means 50 for dispensing washing liquid 100, such as by spraying.

Body 20 is typically toroidal; having a central opening 30, a front 25, and a rear 26. Body 20 further includes a pair of side extensions 24, such as left extension 24A and right extension 24B, which extend to the left and right respectively, and one or more handles 60. Front 25 and rear 26 are defined in relation to the body of a person seated upon bidet seat 10. Front 25 is generally between the person's legs. Left extension 24A is to the left of the person and right extension is to the person's right.

FIG. 2 is a right side, top perspective view of portable bidet seat 10 of FIG. 1. As seen in this view, body 20 further includes a top 21 and a bottom 22, connected by side wall 27 and ring wall 31. Side wall 27 defines the outer perimeter of body 20 and ring wall 31 defines central opening 30.

Bidet seat 10 is placed upon a standard toilet such that bottom 22 is supported by a receiving surface of toilet 100, namely the toilet seat or the rim of the bowl. In the description herein, "toilet rim" means a receiving surface including the seat or rim of a standard toilet, the seat or frame of a portable commode, the seat or frame of a camping toilet, and the seat or sitting surface of an outhouse or pit toilet.

Side wall 27 is pierced by a pair of threaded apertures 28 for communication with hollow chamber 23 inside body 20. Each threaded aperture 28 is adapted to accept either a threaded cap 29 or a pressurizing means 40 with threaded connector, such as hand pump 42. As best seen in FIG. 2, left aperture 28A, has hand pump 42 inserted and right threaded aperture 28B is sealed by cap 29. Cap 29 is removed to add washing liquid 100 to hollow chamber 23.

Side wall 27 and ring wall 31 are depicted in the drawings as being vertical and joining top 21 and bottom 22 at a 90 degree angle, with slight corner relief. Side wall 27 and ring wall 31 may optionally slant one direction or other or may be a convex curve without a well-defined edge with top 21 or bottom 22. In fact, many details of outline and layout may be altered to suit various aesthetic concepts, user needs, or ease of manufacture without sacrificing the benefits of the invention.

As depicted in FIGS. 1 and 2, left aperture 28A is fitted with pressurizing means 40 such as hind pump 42. Hand pump 42 includes a fitting 29A that is similar to cap 29 in diameter and internal threading. Hand pump 42 further includes a piston 44 that penetrates through fitting 29A and into chamber 23. Piston 44 is adapted to be moved by a hand, such as by grip 46. It is beneficial to have left and right apertures 28A,28B so that the person using bidet seat 10 may put pump 42 in either aperture 28 next to the person's stronger or preferred hand. Apertures 28 are preferably disposed away from front 25, where the person's legs would be, so that there is no interference between pump 42 and the person's legs. So that pump 42 is easier to operate by reciprocating movement of the piston or trigger, it is desirable to dispose apertures 28A,28B at an angle so that the person's arm moves along a comfortable path. It has been found that an angle of 20 to 50 degrees relative to the longitudinal axis of bidet seat 10, that is, the from/back axis, provides the strongest and most comfortable stroke of pump 42.

Body 20 is typically formed from molded plastic, only a few millimeters thick, so the thickness of body 20 is not sufficient to form a sturdy threaded receptacle for pump 42 or cap 29. For this reason, a rim or flange (not shown) is preferably molded into body 20 around aperture 28 that extends either outward from side wall 27 or inward into central chamber 23, or both. The flange provides sufficient area and mass of material to secure pump 42 by a threaded connection.

Hand actuated pumps 42 are well known in the art. Two types preferred for the bidet seat 10 of the present invention are the trigger pump sprayer, which draws liquid up a dip tube by creating a partial vacuum, and the compressed air sprayer, which pressurizes the air in contact with the liquid so that liquid is pushed out of an orifice.

Although pressurizing means 40 is illustrated herein as a compressed air sprayer type of hand pump 42, other pressurizing means 40 could also be used, such as a trigger spray pump, a rotary vane pump, a squeeze bulb, or a small cylinder of compressed gas such as carbon dioxide. A small battery-operated pump could also be used, but is not currently preferred due to the lower reliability compared to land-operated pump 42.

While a hand-operated pump 42 is the most preferred pressurizing means 40, other user-operated pumps may be substituted. For example, a user with insufficient strength in the hands or arms might prefer a foot-actuated pump (not shown). A foot pump would require a compression pedal or similar device to be placed on a floor, connected to hollow chamber 23 via a compressed air tube. Such a pump is functionally equivalent to hand-operated pump 42 as illustrated, but with slightly less advantage of portability and convenience of use.

An alternative embodiment of pressurizing means 40, envisioned but not illustrated, harvests the force of the user sitting down for pressurizing washing liquid 100. For example, side wall 27 and ring wall 31 could be adapted to create a bellows from body 20, such as by horizontal pleating of walls 27 and 31. As the user sits down upon bidet seat 10, walls 27, 31 would be resiliently crushed so as to decrease the volume of hollow chamber 23, perhaps by half, thereby doubling the internal pressure. Yet another envisioned embodiment integrates a ring-shaped resilient bladder into top 21 of body 20. The bladder is biased to an expanded position and is crushed to essentially zero volume by the user sitting upon it. The air contained in the bladder is forced through a one-way valve into hollow chamber 23, increasing the internal pressure of chamber 23.

Either of these gravity-assisted pressurizing means 40 would be sufficient for brief but perhaps not extremely forceful dispensing of washing liquid 100; or, in combination with a hand-operated pump 42, either would decrease the amount of pumping needed. So that alternative bidet seat 10 would be as convenient to carry as the preferred embodiment illustrated and claimed herein, body 20 would be restrained in the crushed position such as by straps or a low-volume carrying case when desired.

Whatever pressurizing means 40 is chosen, it will require associated valves and connections appropriate to the specific pressurizing means 40. These are well known and need not be individually discussed in detail herein.

Portable bidet seat 10 further includes dispensing means 50 for washing liquid 100. Dispensing means 50 generally includes conduits for washing liquid 100, such as tubes 52; orifices for dispensing sprays or streams of liquid, such as nozzles 54; and on-off valves 56 for selectively actuating flow from an individual nozzle 54.

Valves 56 allow the user to select only certain nozzles 54 for dispensing washing liquid 100 according to preference. Another important reason for valves 56 is to prevent all dispensing of washing liquid 100 until a sufficient threshold pressure for dispensing has been attained.

Tubes 52 conduct washing liquid from hollow central chamber 23 to nozzles 54. If the selected hand pump 42 is a trigger pump, rotary vane, or peristaltic type pump, the input end of each tube 52 must be connected directly to hand pump 42, which itself has a dip tube (not shown) with an end disposed in a lowest portion of chamber 23. If the selected pump 42 is the compressed air sprayer type, a squeeze bulb, or a compressed gas cylinder, the input ends of tubes 52 are preferably disposed near the lowest portion of hollow chamber 23 so as to pick up washing liquid 100 even when the liquid level is low.

In either case, the output end of each tube 52 is typically connected to a selected nozzle 54 or similar orifice. Nozzles 54 are disposed adjacent to ring wall 31 so as to dispense washing liquid 100 into central opening 30. In a preferred embodiment, best seen in FIG. 1, one or more concavities or reliefs 32 may be formed in ring wall 31 so that nozzles 54 need not protrude into central opening 30. Nozzles 54 must have valve means, as is well known in the art, to prevent flow of liquid from nozzles 54 until sufficient pressure for useful dispensing has been built up.

FIG. 3 is a sectional view of portable bidet seat 10 of FIG. 1, taken along line 3-3 of FIG. 1. Two portions of hollow chamber 23 are seen, with washing liquid 100 in the bottom of chamber 23 and gas such as air 101 filling chamber 23 above washing liquid 100. Ring wall 31 is visible in side view between the two sectioned portions of chamber 23, as well as in section view surrounding chamber 23.

It is best seen in FIG. 3 that each tube 52 passes underneath body 10, such as via a groove 33 molded or otherwise formed into bottom 22, and then emerges into central opening 30, such as into concavity or relief 32. In an alternative embodiment, a tube 52 may pass through hollow chamber 23 to reach the location of its nozzle 54, entering and exiting body 20 via ports (not shown) made liquid-tight such as by a rubber gasket or grommet.

Additionally, if the selected pressurizing means 40 is a type that compresses the gas within hollow chamber 23 (e.g., compressed air sprayer), a nozzle 51 may simply be installed in a lower portion of ring wall 31 to release washing liquid directly from hollow chamber 23, without any tube 52.

An air sprayer 55, for removing liquid 100 from the person's body after washing, is seen in FIG. 3, penetrating ring wall 31 above the level of washing liquid 100. Air sprayer 55 is preferably mounted at either or both of the front- and rear-most sections of ring wall 31, so as to direct compressed air between the seated user's legs from either the front or rear.

This air sprayer 55 is useful when pressurizing means 40 comprises compressed air sprayer pump, a squeeze bulb, or a compressed gas cylinder. Because these types of pressurizing means 40 compress the entire volume of air 101 within chamber 23, air only will flow from air sprayer 55 when actuated. For clarity, the actuation valve for air sprayer 55 is not shown, but such means are well known in the art. For example, the head of air sprayer 55 may twist to turn flow on or off in a similar manner to common garden hose nozzles; alternatively, the head may be pushed or pulled along the length of the shaft, similar to the dispensing caps for many dish detergent or mustard bottles.

If an air sprayer 55 is installed, indicia for maximum level of washing liquid 100 may be printed on or molded into side wall 27, otherwise, care must be taken to only fill hollow central chamber 23 with washing liquid 100 to below the level of air sprayer 55.

Washing liquid 100 is introduced into hollow chamber 23 via either threaded aperture 28. Depending on the user's preference, washing liquid 100 may comprise water, an aqueous solution of soap or detergent, a "no-rinse" body cleanser, or other suitable liquid. Washing liquid 100 may be carried within chamber 23 for transport or may be carried in a separate container and added to chamber 23 when needed. A small volume of a concentrated cleanser may be carried then diluted with tap water when needed.

Optionally, seen in phantom in FIG. 2 only, dividing walls 61 may divide hollow chamber 23 into two portions to accommodate two types of washing liquids 100. So that only one pressurizing means 40 may pressurize both portions of chamber 23, each dividing wall 61 is pierced by a narrow slot or other aperture near top 21 to allow passage of pressurizing gas. Valves 56 are used to select which type of washing liquid 100 is dispensed.

When placed upon a toilet receiving surface, central opening 30 of bidet seat 10 is aligned with a receptacle for receiving waste, such as the water-filled bowl of a standard porcelain toilet 101. The other toilet means listed above also have a functionally equivalent waste receptacle, for example, portable commodes and camping toilets typically include a plastic bag or bucket as a receptacle. Outhouses and pit toilets typically have a pit that may be dug into the earth, or formed of plastic, sheet metal, or concrete.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. A portable bidet seat that is not connected to a source of running water, comprising:

a toroidal body, including:

a top having a central hole, for supporting a person seated upon said top for the purpose of elimination of bodily waste;

a bottom having a central hole, said bottom for being supported by the seat or rim of a toilet;

an outer side wall connecting said top and bottom, a ring wall connecting said top and said bottom and encircling a central opening;

said central opening adapted to communicate with the bowl of the toilet so that excreted body waste and waste washing liquid fall into the toilet bowl for disposal; said top and bottom together with said outer and inner side walls defining a hollow chamber for holding a washing liquid and a pressurizing gas;

a selectively closable aperture in said outer wall for introducing washing liquid into said hollow chamber;

pressurizing means for pressurizing the washing liquid inside said hollow chamber; and dispensing means for directing the washing liquid onto the portion of the seated person that is encircled by said central opening, the flow of liquid being propelled by said pressurizing means.

2. The portable bidet seat of claim 1, wherein said pressurizing means consists of at least one of: a hand-operated pump, a foot-operated pump, and a canister of compressed gas, suitably attached to said toroidal body and in fluid communication with said hollow chamber.

3. The portable bidet seat of claim 2, wherein said pressurizing means is a pump mounted in said selectively closable aperture of said outer wall.

4. The portable bidet seat of claim 1, said dispensing means further including: at least one valve for selectively activating said dispensing means.

5. The portable bidet seat of claim 1, wherein said selectively closable aperture comprises a pair of selectively closable apertures, disposed on opposite sides of said body such that a left said aperture is accessible to the person's left hand and a right said aperture is accessible to the person's right hand; each said aperture capable of receiving said pressurizing means.

6. The portable bidet seat of claim 5, said hollow chamber divided by a vertical partition attached to said bottom surface and said side wall so as to create two separated chambers for holding washing liquid; said partition perforated above the level of washing liquid so as to allow passage of compressed air but not washing liquid.

7. The portable bidet seat of claim 1, wherein said body includes a pair of extensions in a radial direction, so as to provide:

gripping portions for carrying or lifting said portable bidet seat;

support wings to assist the person in rising; and adaptability to a wide range of toilet diameters and size of person seated upon said bidet seat.

8. The portable bidet seat of claim 7; wherein said selectively closable aperture is disposed in said radial extension such that said aperture is generally on the outer side of the seated person's adjacent leg, and the central axis of said aperture projects radially outward at an angle of 20 to 50 degrees relative to the lengthwise axis of said toroidal body.

9. The portable bidet seat of claim 1, said dispensing means including:

a plurality of nozzles for dispensing pressurized washing liquid, disposed adjacent said ring wall such that the dispensed washing liquid flows radially inward into said central opening;

a tube connecting each said nozzle to a source of pressurized washing liquid; and a valve to selectively block or allow the flow of washing liquid in each said tube.

10. A portable bidet seat adapted to make it easier for persons with limited strength or flexibility to use a toilet; comprising;

a hollow toroidal body portion adapted to be placed upon the seat or rim of a toilet having a receptacle for body waste, used toilet paper, and the like, including standard porcelain toilets, sickroom potty chairs, portable camping toilets, and pit toilets; said body portion including:

an upper surface adapted to be sat upon by a person;

an outer wall;

a ring wall defining:

a central opening to allow passage of waste excreted by a person seated upon said upper surface into the receptacle of the toilet; and a hollow interior chamber for holding washing liquid;

pump means for pressurizing the washing liquid;

dispensing means for dispensing pressurized washing liquid into said central opening so as to wash the portion of the seated person's body disposed over said central opening; including:

a plurality of nozzles for dispensing pressurized washing liquid, disposed adjacent said ring wall such that the dispensed washing liquid flows inward into said central opening;

a tube connecting each said nozzle to a source of pressurized washing liquid; and a valve to selectively block or allow the flow of washing liquid in each said tube.

11. The portable bidet seat of claim 10, said body portion further including:

side extensions projecting radially outward from said outer wall, adapted to allow said bidet seat to be placed upon toilets having any standard span across the receptacle opening; said extensions further providing support surfaces on both sides of the person's seated body, for pressing upon to aid in sitting down or standing up.

12. The portable bidet seat of claim 10, said pump means consisting of one of the list: compressed air sprayer, trigger pump sprayer, rotary vane pump, squeeze bulb, bellows, or carbon dioxide cartridge.

* * * * *